US005414925A

United States Patent [19]

Nishide et al.

[11] Patent Number: 5,414,925

[45] Date of Patent: May 16, 1995

[54] MECHANISM FOR INSERTING WIRED TERMINALS INTO CONNECTOR HOUSING

[75] Inventors: Yutaka Nishide; Masao Kobayashi, both of Osaka; Teiji Sakuma; Koji Fujita, both of Yokkaichi, all of Japan

[73] Assignees: Sumitomo Electric Industries, Ltd.; Sumitomo Wiring Systems, Ltd., both of Japan

[21] Appl. No.: 114,044

[22] Filed: Aug. 31, 1993

[30] Foreign Application Priority Data

Sep. 2, 1992 [JP] Japan ..... 4-234793

[51] Int. Cl.[6] ..... H01R 43/00; H01R 9/16

[52] U.S. Cl. ..... 29/748; 29/759

[58] Field of Search ..... 29/33, 748, 747, 752, 29/753, 754, 759, 564.1, 564.6, 564.8

[56] References Cited

U.S. PATENT DOCUMENTS

| | | | |
|---|---|---|---|
| 4,055,889 | 11/1977 | Fusco et al. | 29/748 X |
| 4,520,966 | 6/1985 | Bloch et al. . | |
| 4,779,334 | 10/1988 | Boutcher, Jr. | 29/759 X |
| 4,970,777 | 11/1990 | Folk et al. | 29/748 |
| 5,109,602 | 5/1992 | Fukuda et al. | 29/845 |
| 5,127,159 | 7/1992 | Kudo et al. | 29/754 X |
| 5,315,756 | 5/1994 | Jurjedic et al. | 29/33 M X |

FOREIGN PATENT DOCUMENTS

| | | | |
|---|---|---|---|
| 226665 | 7/1987 | European Pat. Off. . | |
| 452771 | 10/1991 | European Pat. Off. | 29/748 |
| 2330248 | 5/1977 | France . | |
| 2437763 | 4/1980 | France | 29/564.6 |
| 61-61489 | 12/1986 | Japan | 29/753 |
| 1-313872 | 12/1989 | Japan | 29/753 |

*Primary Examiner*—Peter Dungba Vo

*Attorney, Agent, or Firm*—Beveridge, DeGrandi, Weilacher & Young

[57] ABSTRACT

The invention relates to a mechanism for inserting wired terminals into connector housings and includes a terminal moving part for detaching the front end part of the wires from a clamping part and moving the terminals adapted to inwardly return to a lay-out board, a housing holding part for holding a connector housing so that the terminal insertion ports in the connector housing confront the terminals returned to the lay-out board, and a terminal inserting part for inserting the terminals into the terminal insertion ports by bringing the connector housing and the terminals, which terminals are opposite to the terminal insertion ports of the connector housing, closer at the terminal insertion movable region.

19 Claims, 14 Drawing Sheets

MECHANISM FOR INSERTING WIRED TERMINALS INTO CONNECTOR HOUSING

CROSS REFERENCE TO RELATED APPLICATION

This application claims priority benefits under 35 USC section 119 of Japanese Patent Application Serial No. 4-234793, filed Sep. 2, 1992, the disclosure of which is incorporated by reference.

BACKGROUND OF THE INVENTION

1. Field of the Invention

The present invention relates to a mechanism for inserting wired terminals into a connector housing, and more particularly to a mechanism for inserting wired terminals into a connector housing for inserting terminals crimped to wires forming of a wiring harness of an automobile, a copying machine, or the like, automatically into a connector housing.

2. Description of the Related Art

A fabrication process of a wiring harness composed by bundling a plurality of coated wires includes various steps of measuring and cutting wires, stripping insulated sheaths at ends of wires, crimping terminals and bared wire ends together for contacting, inserting terminals into a connector housing, bundling the wires assembled in the connector housing, or the like.

Each fabrication step of a wiring harness conventionally depended on manual labor, but it is recently demanded to automate the process. To meet such demand a mechanism for inserting wired terminals as shown in FIG. 19 was disclosed, for example, in the Japanese Unexamined Patent Publication No. 313872/1989. In this structure, the front end portion of a wire A and a wire crimped portion B1 of a terminal B crimped to the front end of the wire A are set opposite to a terminal insertion port of a connector housing C in a state being clamped respectively by a wire clamp 101 and a terminal clamp 102. The clamps 101, 102 are brought closer to the connector housing C for inserting the front end of the terminal B into the connector housing C, and when the foremost end of the terminal B is inserted somewhat into the connector housing C, clamping of the terminal B by the terminal clamp 102 is cleared, while the wire clamp 101 is further brought closer to the connector housing C with the terminal clamp 102 set aside, so that the terminal B is inserted into the specified position of the connector housing C.

Recently, a lay-out board is used for automating the fabrication steps (see the Japanese Examined Patent Publication No. 61489/1986).

The lay-out board is used for laying out the wire of which configuration is hard to specify according to the wiring configuration of the wiring harness, and the wire is stopped by stopping means on the way. Besides, for the ease of stripping step or crimping step, the front end portion of the wire is clamped by a clamp member disposed outside the lay-out board.

When automating the fabrication steps by using such lay-out board, the prior art shown in FIG. 19 could not be applied directly. That is, in order to insert the terminal B into the connector housing C, it is necessary to move the wire A and terminal B toward the connector housing C by a specified stroke, it is required to allow movement of the wire A and terminal B toward the connector housing C by slacking the intermediate portion of the wire A or sagging in a U-shaped form. However, in the state of laying out the wire A on the lay-out board and clamping the front end portion A1 of the wire A by the clamp member, a sufficient stroke for inserting the terminal B into the connector housing C is not obtained.

Furthermore, the terminal inserting step cannot be automated only by slackening in order to obtain an insertion stroke of the terminal B. That is, when inserting plural terminals B into the connector housing C, the wire A consecutive to the terminal B inserted already in the connector housing C (hereinafter called the inserted terminal) may intersect the terminal B consecutive to the wire A clamped by the clamp member (hereinafter called the non-inserted terminal), depending on the positioning of the terminal B of the laid wire A and the terminal insertion port of the connector housing C. In this case, the wire of the inserted terminal interferes and the non-inserted terminal cannot be held by the terminal clamp 102. This causes disablement of automatic insertion of the terminal B into the connector housing C.

In addition, the following problem also makes it difficult to automate the terminal inserting process. That is, in the terminal crimping step by crimping the wire crimping part B1 formed on the terminal B, the front end of the terminal B may be bent up or bent down(see double dot chain line in FIG. 19) from the crimped part as the bending point P. When such deformation of terminal B occurs, because the terminal clamp 102 is designed to hold the wire crimped part B1 of the terminal B at the bending point P to insert on the basis of the holding position, a misalignment occurs between the front end B2 of the terminal B and the connector housing C, and also because of the narrow gap of the two, the terminal B may not be inserted into the connector housing C.

If the wire A of terminal B side from the portion clamped by the clamp member is bent, the same problem of misalignment occurs. This trouble is particularly evident in a device for inserting the terminal B into the connector housing C only by the wire clamp 101. If there is provided with the terminal clamp 102 for clamping the terminal B, a clamping error of the terminal B may occur, thereby sometimes making it impossible to insert the terminal B into the clamp housing C.

It is hence a primary object of the present invention to present a mechanism for inserting wired terminals capable of inserting terminals of wires laid out on the lay-out board securely and automatically into a connector housing.

SUMMARY OF THE INVENTION

The invention is directed to a mechanism for inserting wired terminals for achieving the above object. More specifically, the present invention comprises a member for clamping a terminal to set the terminal in a state free to displace, and moving the terminal to return inwardly to a layout board. The invention also comprises a member for inserting the moved terminal finally into a connector housing. Hence, according to the present invention, because the movement of the wire and terminal is allowed, it is not necessary to slacken or sag the wire in the intermediate part. Therefore, in the state of laying out the wire on the lay-out board, the terminals can be automatically inserted into the connector housing, which may also contribute to automation of fabrication process of wiring harness.

In an embodiment of the present invention, the wire consecutive to the inserted terminal does not intersect the non-inserted terminal. Hence the conventional problem of interference of the wire for clamping the non-inserted terminal does not occur.

In a preferred embodiment of the present invention, because the terminal chuck grips the front side of the terminal from the wire crimped part, the front end of the terminal can be securely inserted into the connector housing when the terminal is deformed in the terminal crimping step.

In a further preferred embodiment of the present invention, because the terminal can be positioned at a specific position, the terminal can be always gripped at the specific position by the terminal chuck.

In another preferred embodiment of the present invention, bending of the front end part of the wire or the terminal can be straightened, misalignment due to bending of wire front end part or the terminal can be prevented, so that defective terminal insertion can be prevented.

These and other objects, features and effects of the present invention will be better appreciated and understood from the following detailed description of the embodiments given by reference to the accompanying drawings.

DESCRIPTION OF PREFERRED EMBODIMENTS

Figure 3:
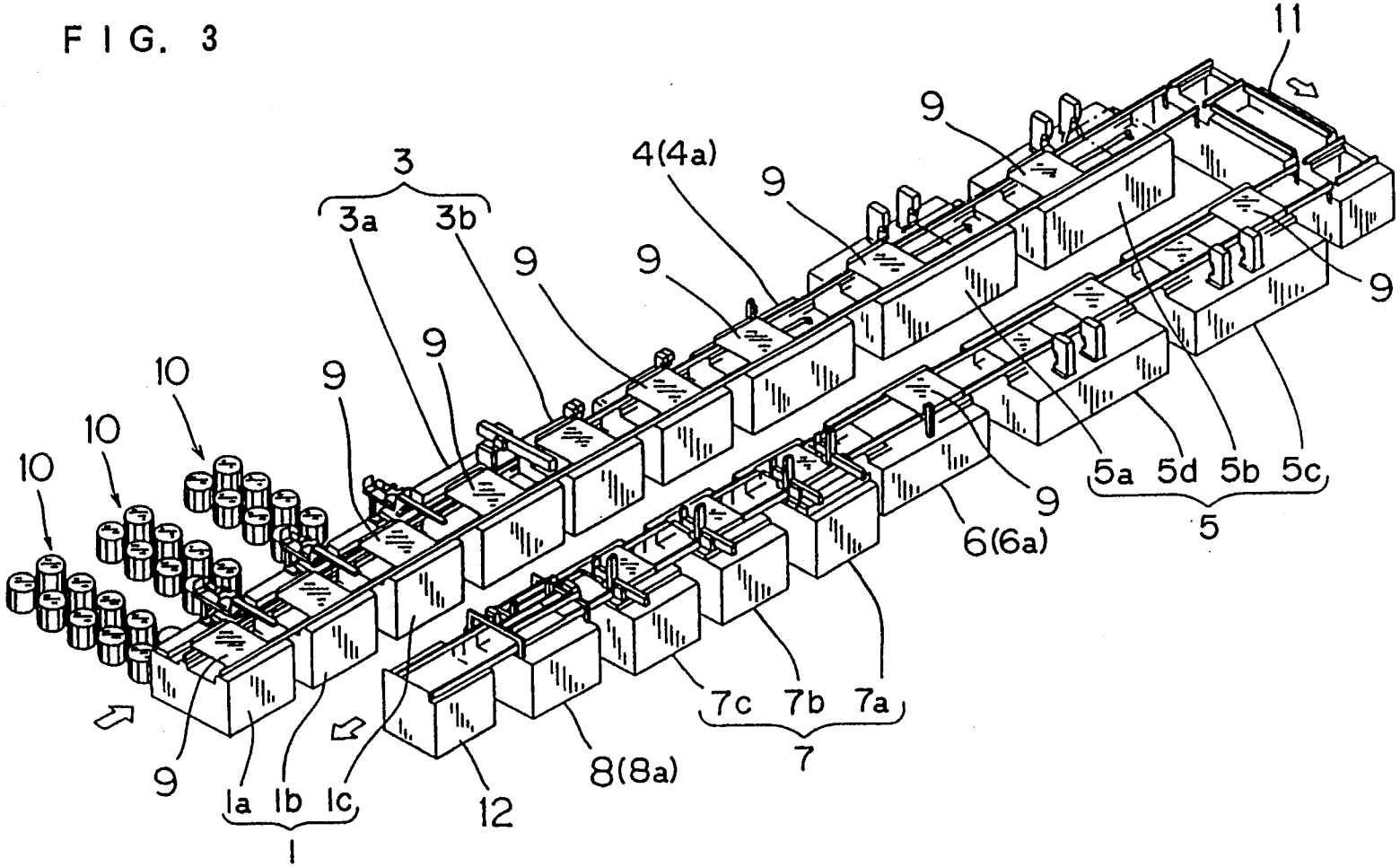
FIG. 3 is a perspective view showing a manufacturing line of wiring harness employing the mechanism for inserting wired terminals of the present invention.

FIG. 3 is a perspective view showing a manufacturing line of wiring harness using a mechanism for inserting wired terminals into connector housing of the present invention. This manufacturing line is composed by arraying and coupling a specified number of modules in each section for each step.

More specifically, the manufacturing line comprises an automatic laying section 1, an automatic taping section 2, a stripping section 3, a stripping inspection section 4, a terminal crimping section 5, a crimping inspection section 6, a terminal inserting section 7, and a conduction inspection section 8, which are coupled in series in this order.

The individual sections 1 to 8 are respectively realized by three automatic laying modules 1*a*, 1*b*, 1*c*, one automatic taping module 2*a*, two stripping modules 3*a*, 3*b*, one stripping inspection module 4*a*, four terminal crimping modules 5*a*, 5*b*, 5*c*, 5*d*, one crimping inspection module 6*a*, three terminal inserting modules 7*a*, 7*b*, 7*c*, and one conduction inspection module 8*a*.

When the wiring harness is manufactured in this manufacturing line, a lay-out board 9 is conveyed sequentially from the automatic laying section 1 to the conduction inspection section 8, section after section, so that the wiring harness is assembled on the lay-out board 9.

Figure 2:
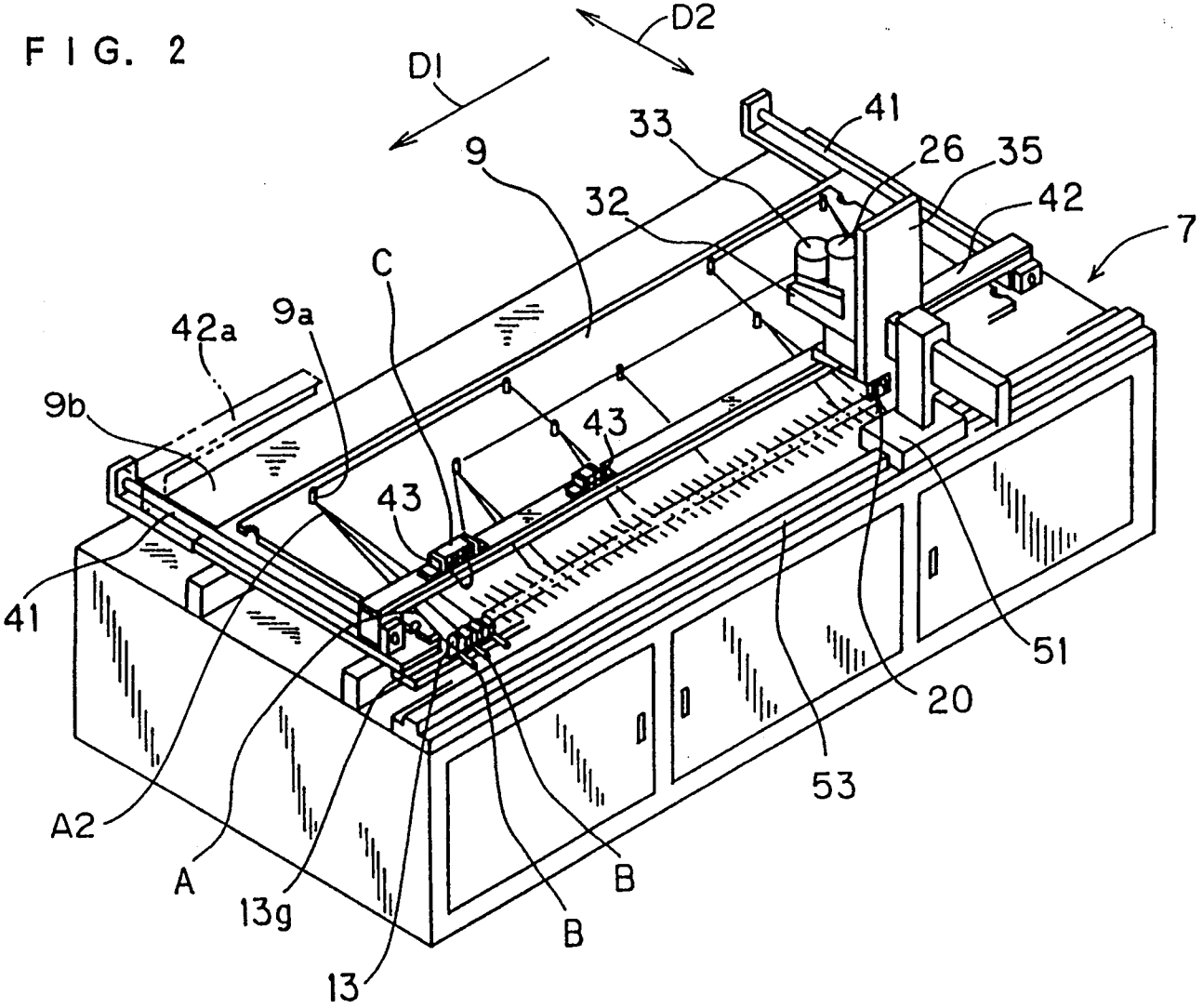
FIG. 2 is a perspective view showing the entire structure of the mechanism for inserting wired terminals.

Referring now to FIG. 2, the lay-out board 9 is a rectangular board, and multiple laying pins 9*a* are planted on its surface. As mentioned later, an intermediate part A2 of the wires A forming of the wiring harness are stopped by the laying pins 9*a*, in the automatic laying modules 1*a*, 1*b*, 1*c* of the automatic laying section 1, and the wires A are laid out on the lay-out board 9.

The lay-out board 9 is supported by a moving stand 9*b* sequentially moving through the sections. On the moving stand 9*b*, clamp members 13 are mounted along one side of the lay-out board 9. As shown in FIG. 2, supposing the conveying direction of the moving stand 9*b* to be D1, and the direction confronting the terminal inserting section 7 orthogonal to the conveying direction D1 to be a confronting direction D2, the clamps 13 are disposed in a multiplicity along a side of the terminal inserting section 7 side in the confronting direction D2.

Each clamp member 13 is intended for elastically clamping and holding each one of the front end parts A1 of the wires A, and is fitted to a long mounting frame 13*g* fixed at a specified position of the moving stand 9*b*. The clamp member 13 includes a pair of clamps 13*b* having a tapered end, and a U-shaped leaf spring 13*c* for biasing the pair of clamps 13*b* in the mutually approaching directions. Leaf spring 13*c* of each clamp member 13 is led into a groove 13*h* of the mounting frame 13*g*, and is fixed to the mounting frame 13*g* by a screw (not shown) driven through a penetration hole 13*d* formed in the bottom. The pair of clamps 13*b* are prevented from slipping out upwardly by pins 13*f* penetrating through holes 13*e* partitioned by the rounding surfaces formed on both and the mounting frame 13*g*.

As shown in FIG. 2, a housing holding part 40 is further formed on the moving stand 9*b*.

The housing holding part 40 includes a pair of slide guide bars 41 fixed and disposed at the upstream side and downstream side of the conveying direction D1 of the moving stand 9*b*, a long slide frame 42 slidably mounted between the slide guide bars 41, and a holding frame 43 for holding the connector housing C at the specified position of the slide frame 42. The housing holding part 40 is to hold the connector housing C in the state where the end surface of the connector housing C, in which the terminal insertion hole is formed is directed along the confronting direction D2. Slide frame 42 is set aside to the rear end side of the lay-out board 9 so as not to interfere with the laying work as indicated by double dot chain line 42*a* in FIG. 2 in the steps before the terminal inserting step. When the lay-out board 9 is conveyed to the terminal inserting section 7, manually or automatically by the driving means not shown in the drawing, it is designed to slide to move to the front end side of the lay-out board 9, that is, in the insertion movable region of the terminal B.

The housing holding part usable in the present invention is not particularly limited to the one shown in the foregoing embodiment provided that it is capable of holding the connector housing C in a specified state in the terminal inserting step. For example, such mechanism may be provided in the terminal inserting section 7.

Figure 4:
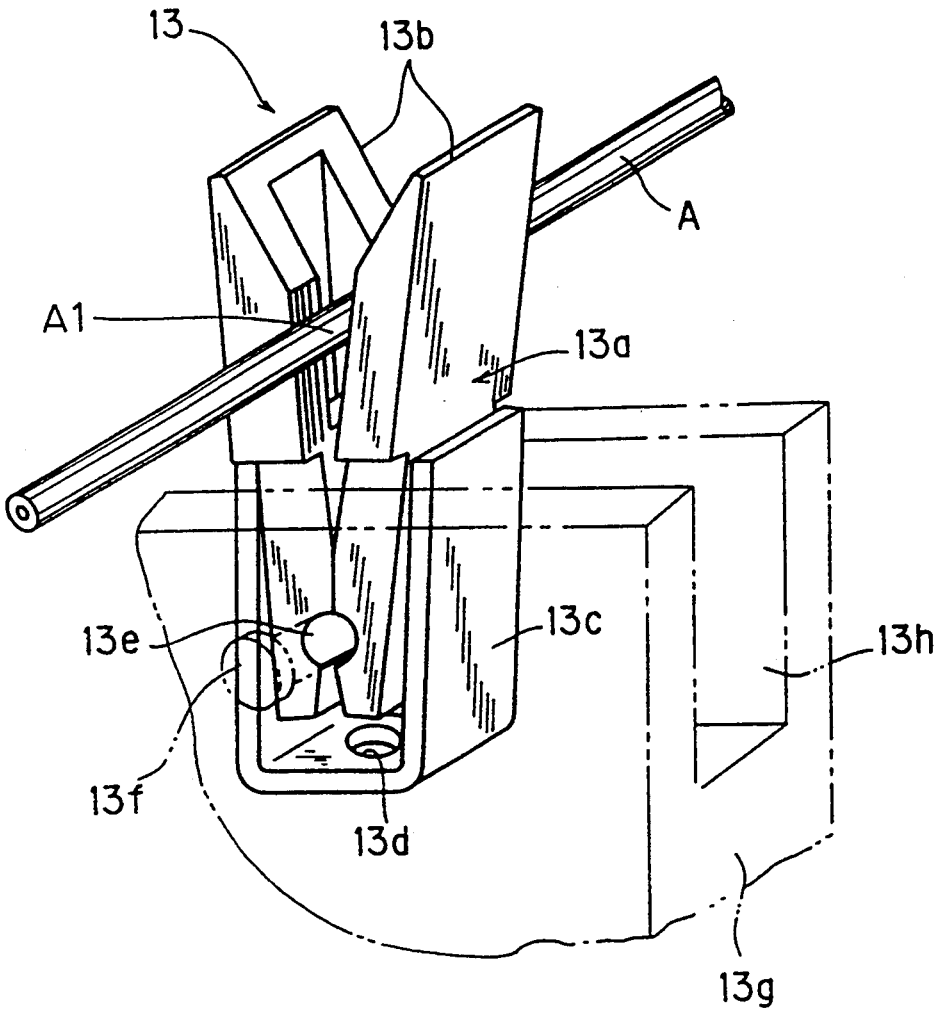
FIG. 4 is a perspective view showing a clamp member.

Returning to FIG. 3, the automatic laying section 1 is a section for automatically laying out a wire of a specific length on the lay-out board 9. In the vicinity of each automatic laying section 1, wire groups 10 of specified types necessary for laying out are disposed, and wires of these wire groups 10 are taken into the automatic laying section 1 selectively, and laid on the lay-out board 9, and cut to specified length. In this step, the front ends A1 of the plurality of laid wires A are held by the clamp member 13 in a state of being projected from one side of the lay-out board 9 as shown in FIG. 4. Intermediate parts A2 of the wires A are stopped by the laying pins 9*a* on the lay-out board 9 as shown in FIG. 2. In this embodiment, for the convenience in the later steps, the wires A are taut between the clamp member 13 and laying pins 9*a*. The wires A laid on the lay-out board 9 contain various types depending on the circuit necessary in the wiring harness, ranging from thick size to thin size of the wires A.

The lay-out board 9 on which wires are laid in the automatic laying section 1 are sent into the automatic taping section 2 coupled at the downstream side by the moving stand 9*b*, and the laid wires are taped at a specified position so that the wire bundle may not get loose.

The lay-out board 9 is then sent into the stripping section 3 coupled in series to the downstream side of the automatic taping section 2. In the stripping section 3, the coating of the front ends of the wires A laid on the lay-out board 9 is stripped off.

The lay-out board 9 after the stripping step is sent to the stripping inspection section 4 coupled to the downstream side of the stripping section 3. In the stripping inspection section 4, for example, an inspection camera is installed, and striping of the front ends of the wires A is inspected, checking if the front ends of the stripped wires A are bent or loosened. As a result of inspection, if a defective stripping end of wires A is detected, the lay-out board 9 possessing such defective wires A may be automatically removed from the manufacturing line, or detection of the defective stripping of wires A may be noticed by lamp or the like.

The lay-out board 9 successfully passing through the stripping inspection section 4 is sent into the terminal crimping section 5. In the terminal crimping section 5, four terminal crimping modules 5*a*, 5*b*, 5*c*, 5*d* are coupled in series.

In the manufacturing line, because the manufacturing line is folded back at the downstream side of the second terminal crimping module 5*b*, a conveying buffer section 11 is inserted between the second terminal crimping module 5*b* and the third terminal crimping module 5*c*. In the conveying buffer section 11, the lay-out board 9 sent from the second terminal crimping module 5*b* is folded back and conveyed into the conveying line and is sent out to the third terminal crimping module 5*c*. Also in the conveying buffer section 11, the conveyance of the lay-out board 9 is stopped for a predetermined time, and the timing for sending out the lay-out board 9 to the third terminal crimping module 5*c* is adjusted.

In the terminal crimping section 5 consisting of four modules, terminals B(see FIG. 2) are crimped to the exposed cores of the wires A after stripping the coated ends off in a state being outward of i.e. outwardly beyond the lay-out board 9.

At the downstream side of the terminal crimping section 5, the crimping inspection section 6 is coupled. In the crimping inspection section 6, for example, an inspection camera is installed, and it is inspected whether the terminal B is crimped correctly to the front end of the wire A. It is also checked if the front end of the wire A to which the terminal B is crimped is bent abnormally or not.

If defective crimping of wires is found as a result of inspection in the crimping inspection section 6, the same as in the case of stripping inspection section 4, the lay-out board 9 having defectively crimped wires A may be removed automatically from the manufacturing line, or defective crimping may be warned by lamp or the like.

The lay-out board 9 passing through the crimping inspection section 9 is set to the terminal inserting section 7. In the terminal inserting section 7, three terminal inserting modules 7*a*, 7*b*, 7*c* are arranged in series. The terminal inserting modules 7*a*, 7*b*, 7*c* are realized by terminal inserting devices for automatically inserting the terminals B crimped to the front ends of the wires A into the connector housing C (see FIG. 2), and they compose the principal block of the mechanism for inserting wired terminals into connector housing together with the housing holding part 40 of the lay-out board 9 mentioned above.

In this embodiment, for example, the first terminal inserting device 7*a* inserts terminals of a group a into the connector housing C, the second terminal inserting device 7*b* inserts terminals of a group b into the connector housing C, and the third terminal inserting device 7*c* inserts terminals of a group c into the connector housing C.

Figure 1:
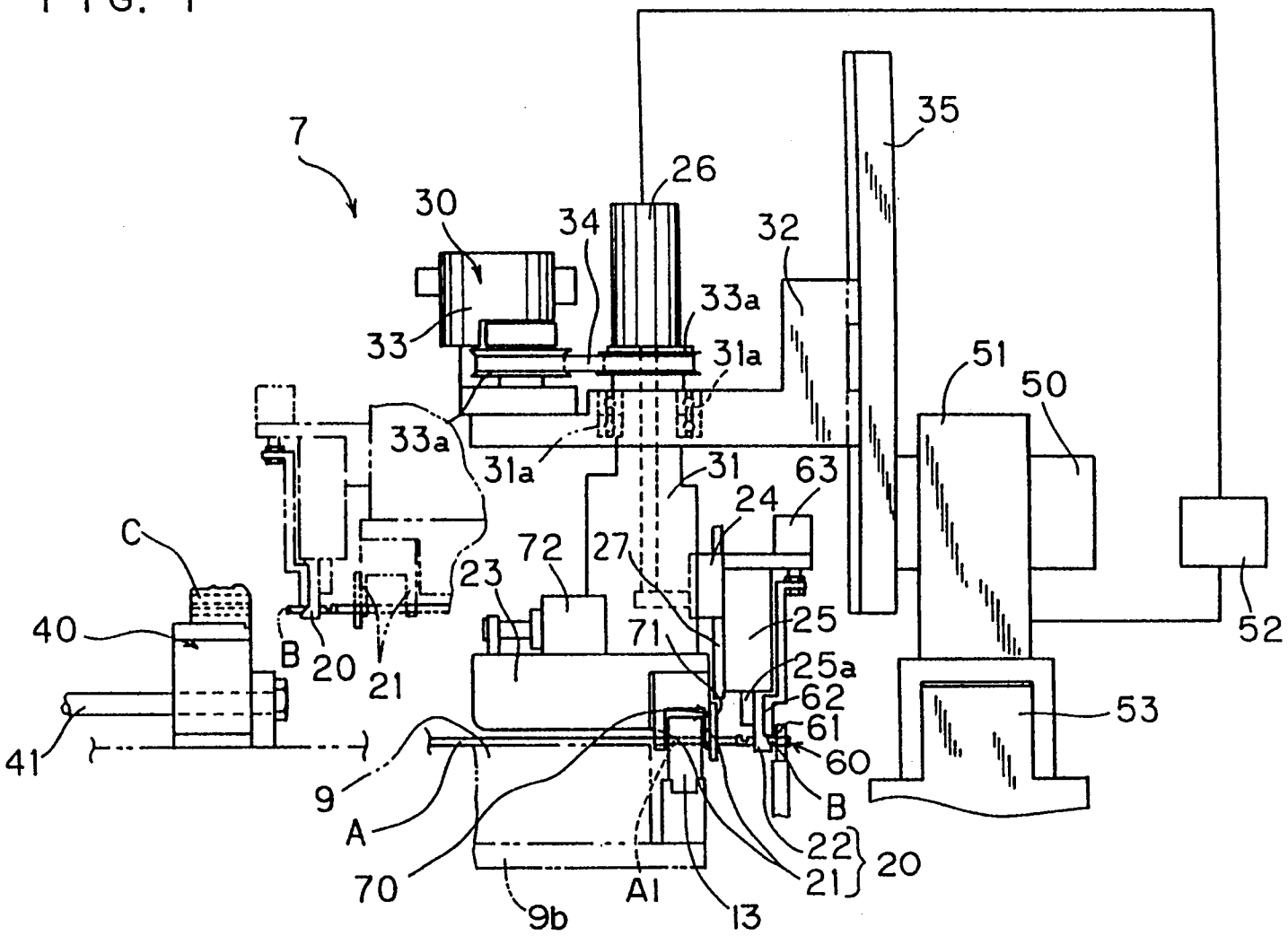
FIG. 1 is a schematic partial side view showing a mechanism for inserting wired terminals of the present invention.
Figure 9:
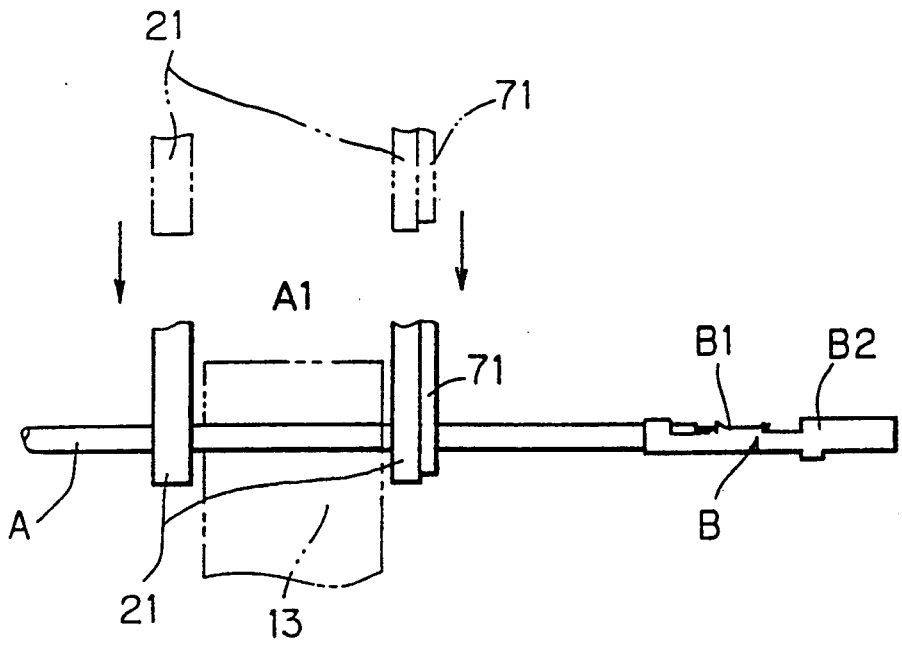
FIG. 9 is a schematic diagram showing the state of lowering of wire chuck.

Referring to FIG. 1 and FIG. 2, the terminal inserting module 7*a* is mainly formed of a chuck part 20 including a wire chuck 21 for gripping the ends of the wires A held by the clamp member 13 and a terminal chuck 22 for gripping the terminals B crimped to the wires A, a terminal moving part 30 for moving the terminal so as to be opposite to the terminal insertion port of the connector housing C held by the housing holding part 40, by directing the front ends B2 (see FIG. 9) of terminals B inward of the lay-out board 9 by turning the chuck part 20 about 180 degrees in the state of gripping the wires A and terminals B, a terminal inserting part 50 for inserting the terminals B into specified positions of the connector housing C by bringing the chuck part 20 closer to the connector housing holding part 40, a terminal straightening part 60 for positioning and straightening the terminals B at specific positions, prior to gripping of the terminals B by the terminal chuck 22, and a wire straightening part 70 for straightening the bending of the ends by combing the ends of the wires A.

Figure 5:
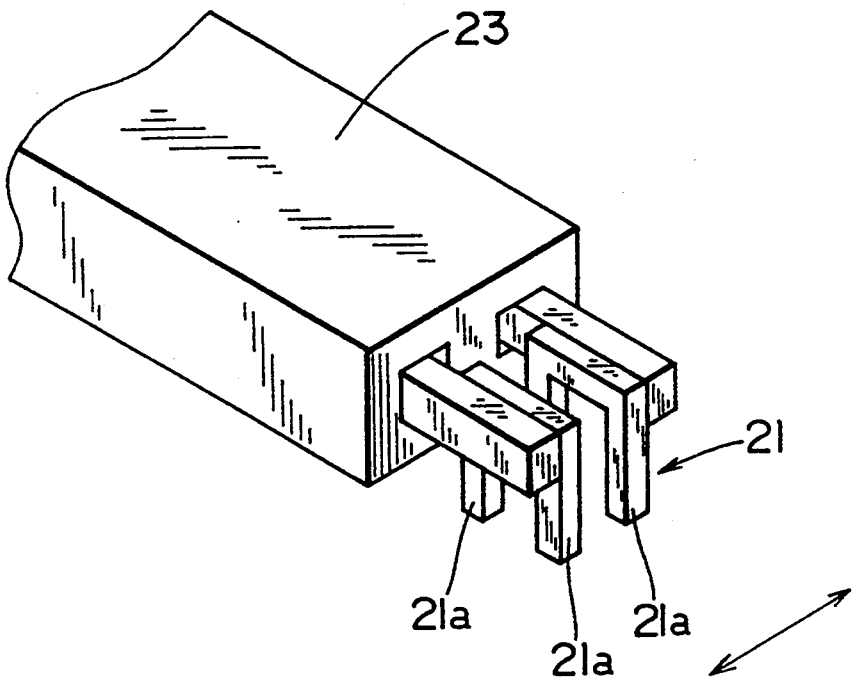
FIG. 5 is a perspective view showing a wire chuck.

The wire chuck 21 of the chuck part 20 is provided with plural pairs of chuck pawls 21*a* (See FIG. 5) confronting each other, and is designed to clamp immobile plural positions of the wires A by the chuck pawl 21*a*. The chuck part 20 has an air chuck 23 for opening and closing the wire chuck 21, and the chuck pawls 21*a* are directly opened and closed by the air chuck 23. The chuck part 20 has an releasing bar 27 for unclamping the wires A from the clamp member 13. The unclamping bar 27 is lowered by a cylinder not shown when gripping and picking up the wires A by the wire chuck 21 to get in between the clamps 13*b* of the clamp member 13, and the clamps 13 are opened so that the wires A may be picked up easily. The chuck part 20 is integrally mounted on a rotary frame 31 which rotates about the vertical shaft.

Figure 6:
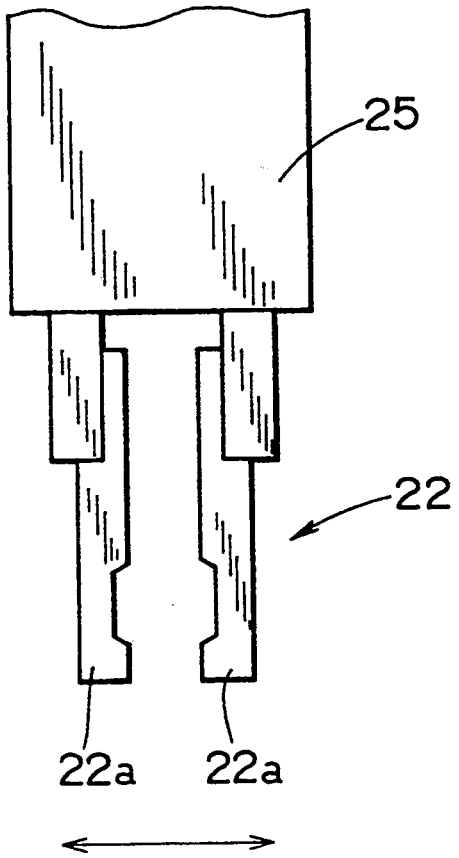
FIG. 6 is a front view showing a terminal chuck.
Figure 12:
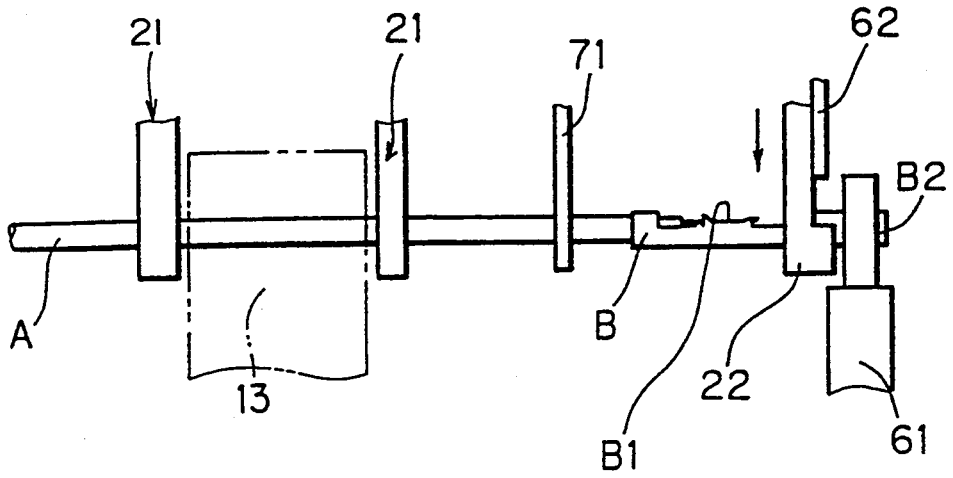
FIG. 12 is a schematic diagram showing a lowered state of a terminal chuck.

The terminal chuck 22 is mounted elevatably on the rotary frame 31 through a first elevating frame 24. The terminal chuck 22 formed of a pair of chuck pawls 22*a* as shown in FIG. 6, and each chuck pawl 22*a* is directly fitted to an air chuck 25 fixed on the first elevating frame 24, and its opening and closing operations are effected by the air chuck 25. The terminal chuck 22 is to grip the front B2 side of the wire crimping part or press-connecting part B1 of the terminal B (FIG. 12), and is elevated or lowered by a cylinder 26 described later through the first elevating frame 24.

The terminal moving part 30 includes a second elevating frame 32 of which front end side is extended in the horizontal direction, a rotary actuator 33 mounted on the horizontal part of the second elevating frame 32, the rotary frame 31 rotatably mounted on the second elevating frame 32 through a bearing 31*a*, a pair of pulleys 33*a* for transmitting the driving force of the rotary actuator 33 to the rotary frame 31, and a timing belt 34 applied between the both pulleys 33*a*, in which the rotary frame 31 can be alternately rotated in the clockwise direction and counterclockwise direction by 180 degrees from the state indicated by solid line in FIG. 1 to the state indicated by double dot chain line. The second elevating frame 32 is slidably mounted on an elevating guide 35 extending in the vertical direction, and is driven vertically by an actuator not shown in the drawing. The position control of the second elevating frame 32 is effected accurately by using, for example, a linear scale. To the second elevating frame 32, the cylinder 26 is fixed for elevating and lowering the first elevating frame 24.

The terminal inserting part 50 includes a post 51 for movably supporting the elevating guide 35 in the confronting direction D2, a first drive mechanism (not shown) for moving the elevating guide 35, and a second drive mechanism (not shown) for moving the post 51 along a slide rail 53 provided parallel to the conveying direction D1 of the lay-out board 9. Each drive mechanism is formed of a slide mechanism combining, for example, a pulse motor and a ball screw, and is controlled by a control part 52 described later, so that each member may be moved to the position capable of accurately gripping the wires A and terminals B by the chuck part 20, and the position for accurately inserting the terminals B to the connector housing C.

The terminal straightening part 60 is provided elevatably immediately beneath the terminals B and includes a locate chuck 61 which receives the front ends B2 of the terminals B and grips the front ends B2 in that state, and a terminal holder 62 for holding down from above the terminals B received by the locate chuck 61, which is driven vertically by a cylinder 63 mounted on the first elevating frame 24. The terminal straightening part 60 is to position the terminals B in one specified position, and further straighten the terminals, so that the terminal chuck 22 can grip the terminals B always in the specified position. In this embodiment, the terminal straightening part 60 is integrally mounted on the post 51 by a frame member not shown, so as to be moved together with the post 51.

Figure 7:
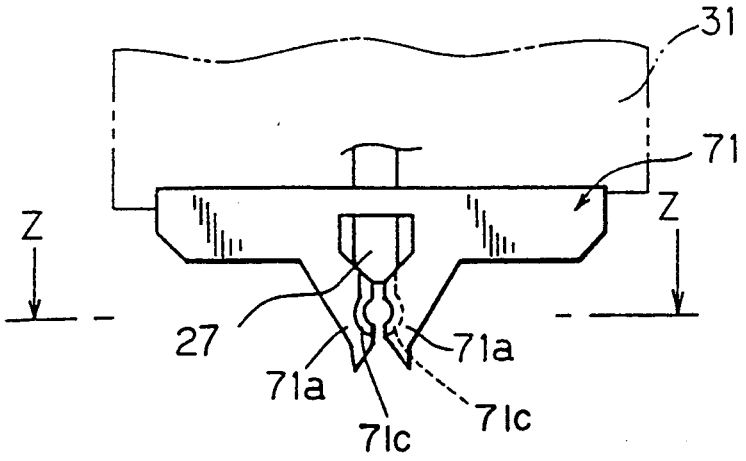
FIG. 7 is a front view showing essential parts of a wire straightening unit.
Figure 8:
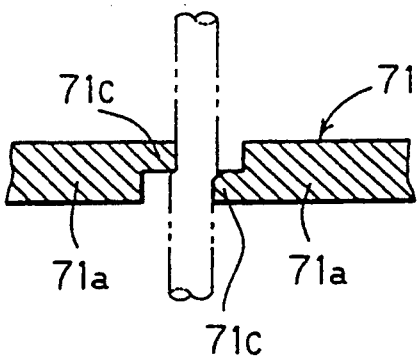
FIG. 8 is a sectional view of Z—Z in FIG. 7.

The wire straightening part 70 includes a combing member 71 adjacent to the wire chuck 21, and a cylinder 72 for moving the combing member 71 from the clamp member 13 side to the terminals B. The combing member 71 is so assembled as to be movable to the terminals B relatively to the wire chuck 21, and is coupled with the cylinder 72 through a coupling mechanism not shown in the drawing. The combing member 71 has a pair of straightening pawls 71*a* for slidably gripping the wires A as shown in FIG. 7. The pair of straightening pawls 71*a* are opened and closed in cooperation with the wire chuck 21 by the air chuck 23 for opening and closing the wire chuck 21. The pair of straightening pawls 71*a* have protrusions 71*c* projecting in the state mutually deviated in the longitudinal direction of the wires A, thereby combing the wires A effectively.

The control part 52 is composed of microcomputer and other electric parts, and is designed to drive and control the members of the corresponding modules.

When the lay-out board 9 is conveyed to the specified position of the terminal inserting section 7 by the moving stand 9*b*, the lay-out board 9 stands still at the position indicated in FIG. 2. The post 51 is moved along the slide rail 53 to the position corresponding the wires A held by the specified clamp member 13, and the terminals B crimped at the end of the wires A. At the same time, the slide frame 42 of the housing holding part 40 mounted on the moving stand 9*b* of the lay-out board 9 is driven in the specified method, and the connector housing C held in the holding member 43 is preliminarily moved into the insertion movable region of the terminals. In this state, the second elevating frame 32 is lowered along the elevating guide 35, and the wire chuck 21 and combing member 71 are lowered to the position capable of gripping the wires A with the pawls 21*a*, 71*a* being open (see FIG. 9).

Figure 10:
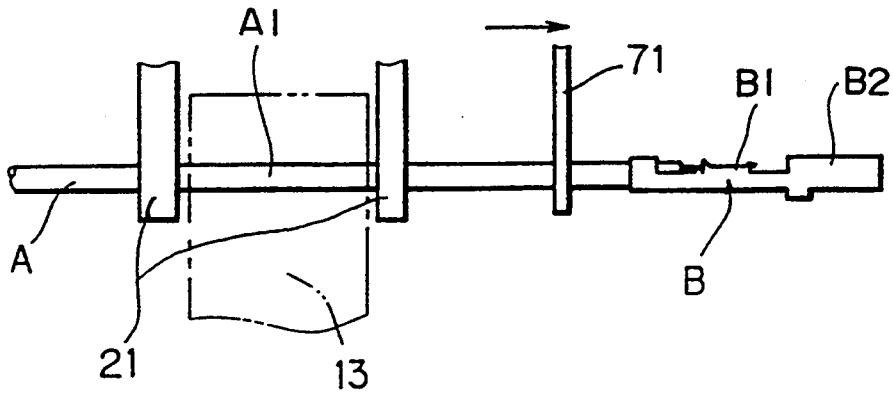
FIG. 10 is a schematic diagram showing a combing state of wire.

Consequently, the air chuck 23 is driven, and the pawls 21*a*, 71*a* of the wire chuck 21 and combing member 71 respectively are closed simultaneously, thereby gripping the wires A. In this state, the cylinder 72 is driven, and the combing member 71 is moved toward the front end of the wires A to comb the wires A, thereby straightening the bending of the wires A (see FIG. 10).

Figure 11:
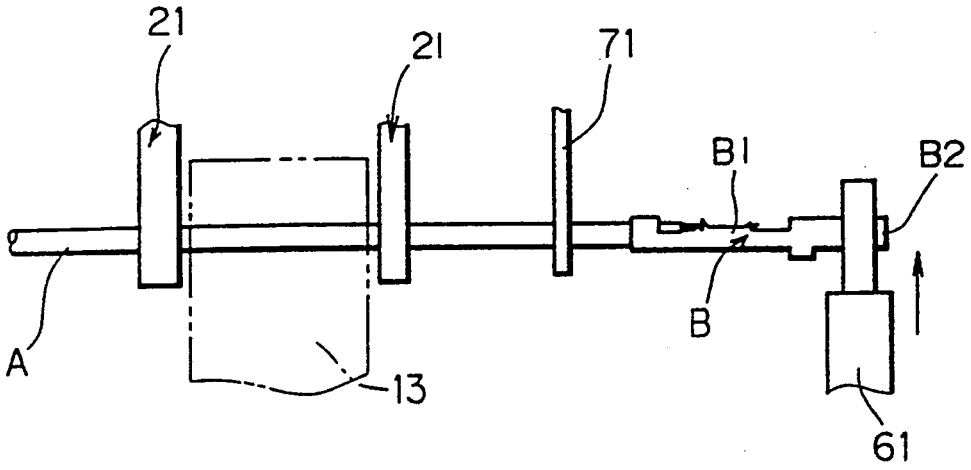
FIG. 11 is a schematic diagram showing a raised state of a locate chuck.

When the locate chuck 61 of the terminal straightening part 60 is elevated, the lower surface of the terminals B is received by the locate chuck 61, and positioning is effected (see FIG. 11). Furthermore, with the terminals B being received by the locate chuck 61, the cylinder 26 is driven, and the terminal chuck 22 is lowered, with the chuck pawls 22*a* being open (see FIG. 12).

Figure 13:
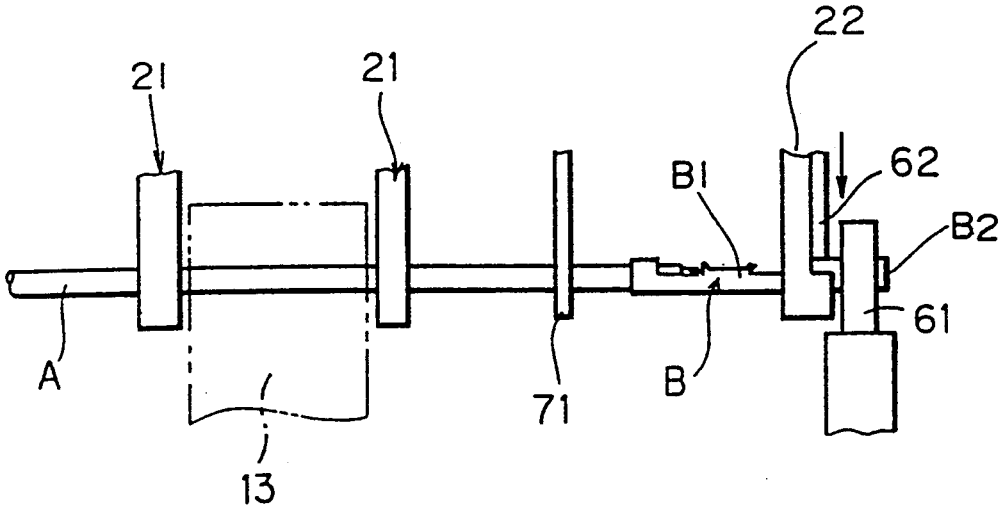
FIG. 13 is a schematic diagram showing a lowered state of a terminal holder.

The cylinder 63 is driven, the terminal holder 62 is lowered, and the front ends B2 of the terminals B are clamped between the terminal holder 62 and the locate chuck 61. As a result, the terminals B are positioned in the vertical direction (see FIG. 13). In consequence, the locate chuck 61 is closed, and the terminals B are positioned and straightened in the lateral direction, then the air chuck 23 is driven, the terminal chuck 22 is closed, and the wires A are griped.

Figure 14:
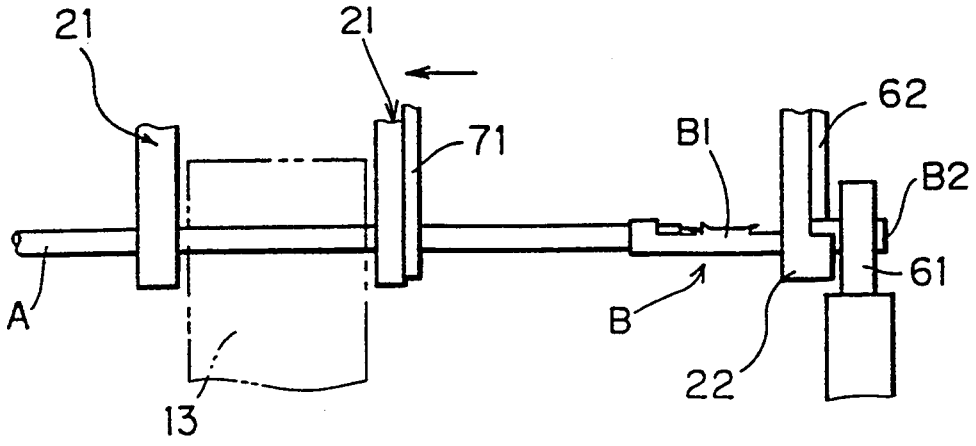
FIG. 14 is a schematic diagram showing the state of a combing member returning to the home position.
Figure 15:
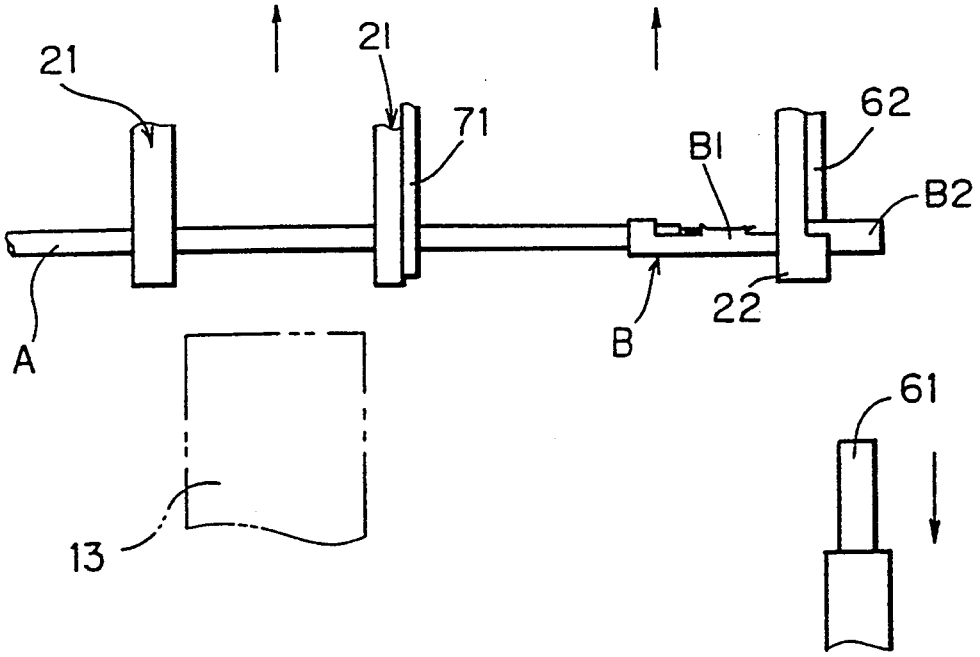
FIG. 15 is a schematic diagram showing the state of picking up a wire and a terminal.
Figure 16:
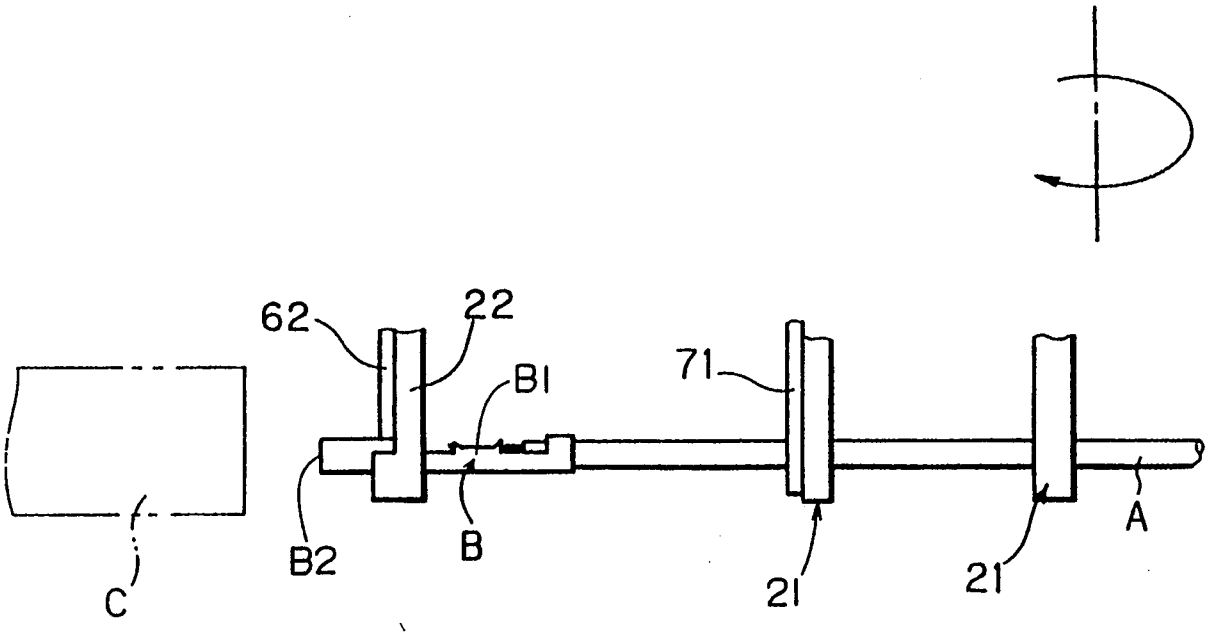
FIG. 16 is a schematic diagram showing the state of inverting the terminal and wire.

When the wires A are griped, the combing member 71 returns to the wire chuck 21 side (see FIG. 14), and the locate chuck 61 is opened at the same time to lower to the home position. The second elevating frame 32 is raised, and the chuck part 20 picks up the terminals B and wires A (see FIG. 15). Prior to this pickup action, the unclamping bar 27 is lowered to open the clamp member 13, thereby making it ready to pick up the front ends A1 of the wires A. When the pickup is over, the front ends A1 of the wires A are released from the clamp member 13, and set free. Furthermore, the rotary actuator 33 is driven, and the rotary frame 31 is turned by 180 degrees (double dot chain line in FIG. 1, and see also FIG. 16). Consequently, the terminals B are returned inward of the lay-out board 9. As required, by moving the post 51 along the slide rail 53, the front ends B2 of the terminals B confront the specified connector housing C waiting preliminarily in the insertion movable region of the terminals B. At the time of pickup action, by presetting the ascending stroke of the chuck part 20 in a specified value, the height of the terminals B may be set precisely opposite to the terminal insertion port of the connector housing C held in the housing holding part 40.

Figure 17:
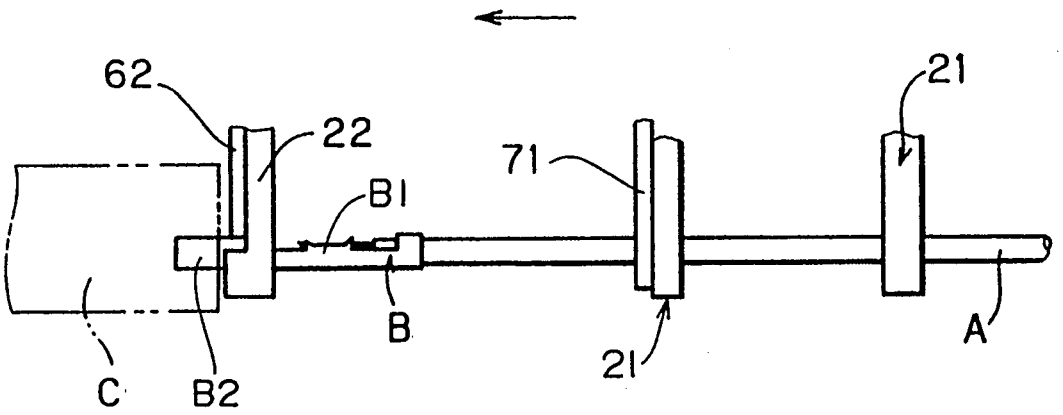
FIG. 17 is a schematic diagram showing an intermediate process of inserting the terminal.
Figure 18:
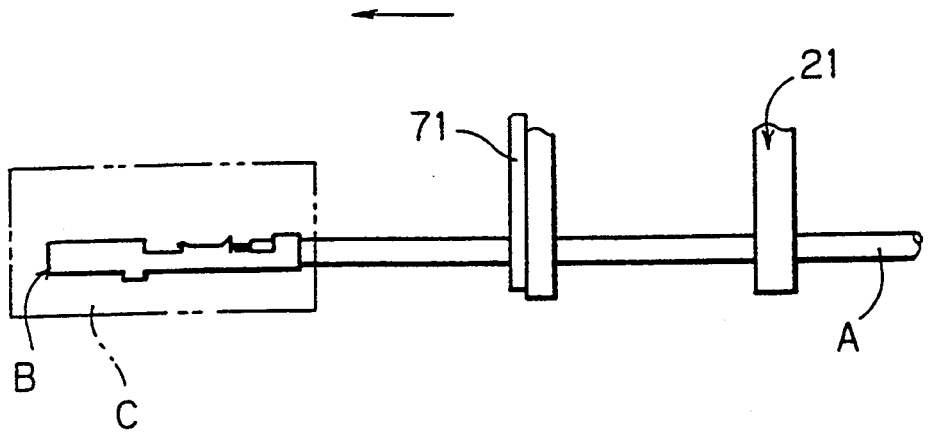
FIG. 18 is a schematic diagram showing the completion state of insertion of terminal.
Figure 19:
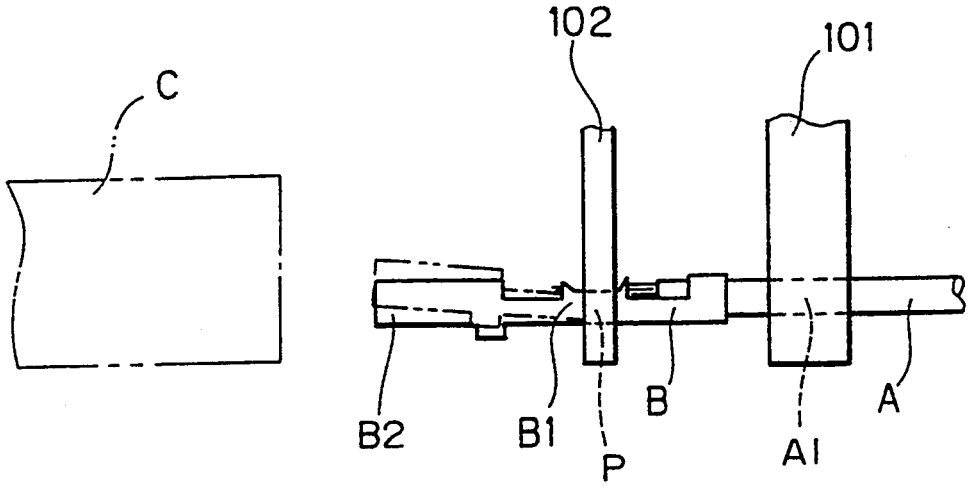
FIG. 19 PRIOR ART
FIG. 19 is a schematic diagram showing prior art.

By driving the terminal inserting part 50, the chuck part 20 is moved to the connector housing C through the elevating guide 35, second elevating frame 32, rotary frame 31 and others, and the terminals B are inserted into the connector housing C (see FIG. 17). When the front ends B2 of the terminals B are inserted into the connector housing C by the specified amount, the terminal chuck 22 is opened to cancel the gripping state of the terminals B, and the cylinder 26 is driven by the control part 52, and the terminal chuck 22 and terminal holder 62 are set aside upward, while the wire chuck 21 is further moved closer to the connector housing C side by the terminal inserting part 50, and the terminals B are inserted into the specified position of the connector housing C (see FIG. 18).

By repeating this operation on every wire A held by each clamp member 13, the terminal B can be inserted into the connector housing C.

Thus, in the terminal inserting section 7, the ends of the wires A held by the clamp member 13 are inverted together with the terminals B, and inserted into the connector housing C, and therefore it is possible to insert the terminals B in the state of being laid out on the lay-out board 9, without having to slacken or sag the intermediate part of the wires A for allowing to move to the connector housing C side.

Moreover, according to the embodiment, there is no risk of intersection of the wires consecutive to the inserted terminals with the non-inserted terminals. Hence, the conventional problem of interference of the wires during clamping of the non-inserted terminals does not occur.

When inserting the terminals B, because the terminal chuck 22 grips the front end B2 side of the wire crimped part B1 of the terminals B, if the terminal is deformed in the prior step of terminal crimping process, such terminal B can be securely inserted into the connector housing C.

Furthermore, prior to holding of the terminals B by the terminal chuck 22, because the terminals B are positioned at a specified position by the terminal straightening part 60, the terminals B may be always griped at high positioning precision by the terminal chuck 22. Accordingly, the terminals B can be securely inserted into the connector housing C.

Still more, because bending of the end is straightened by combing the end of the wires A by the wire straightening part 70, when leading the wires A into the connector housing C by the wire chuck 21 only by setting aside the terminal chuck 22, terminals B are prevented from colliding against the specified part in the connector housing C. Besides, it is easier to grip the terminal B by the locate chuck 61, further enhancing the positioning precision of the terminals B.

The terminal inserting module is not limited to the embodiment, and the terminal inserting part 50 is not particularly defined provided that it is capable of moving the housing holding part 40 side to the direction of the terminal chuck 22 and wire chuck 21.

Back to FIG. 3, the lay-out board 9 passing through the terminal inserting section 7 is conveyed to the conduction inspection section 8. In the conduction inspection section 8, an inspection coupler is connected to the connector housing C in which terminals B are inserted, and the conduction of the laid wires A is inspected. As a result of conduction inspection, if any lay-out board 9 having a defective conduction wire A is found, such lay-out board 9 may be automatically removed from the manufacturing line, or the detection of defective conduction may be alarmed by any means.

The lay-out board 9 successfully passing through the conduction inspection section 8 is conveyed to the buffer section 12. The lay-out board 9 sent out to the buffer section 12 is regarded as being finished in the processing in this manufacturing line, and is forward to the next manufacturing process.

The invention is not limited to the above embodiment alone. The foregoing embodiment is a mere illustrative example for disclosing the technical nature of the present invention, and the present invention should not be interpreted in a narrow sense of meaning by limiting to this practical example only. Hence, the true spirit and scope of the present invention should be limited only by the description of the accompanying claims.

We claim:

1. A mechanism for inserting a terminal, fixed at an end of a wire, into a connector housing, wherein the wire has an intermediate part laid out and held on a lay-out board and a front end part clamped by clamping means disposed outwardly beyond the lay-out board whereby the terminal also is located outwardly beyond the lay-out board, said mechanism comprising:

terminal moving means for detaching the front end part of the wire from said clamping means, and for moving the terminal inwardly to return the terminal to the lay-out board, housing holding means for holding the connector housing above the lay-out board so that a terminal insertion port in the connector housing confronts the terminal returned to the lay-out board by said terminal moving means, and terminal inserting means for inserting the terminal into the terminal insertion port of the connector housing by bringing the connector housing and the terminal together, the terminal being in opposition to the terminal insertion port of the connector housing.

2. A mechanism for inserting a wired terminal according to claim 1, wherein said terminal moving means includes a wire chuck for gripping the front end part of the wire clamped by said clamping means, and a terminal chuck for gripping the terminal of the wire after said wire chuck has gripped the front end part of the wire.

3. A mechanism for inserting a wired terminal according to claim 2, wherein when the terminal has a front end and a base end between which is disposed a crimpable core press-connecting part that is to be crimped to a core of the wire, said terminal chuck grips a portion of the terminal between the front end and the core press-connecting part of the terminal.

4. A mechanism for inserting a wired terminal according to claim 2, wherein said terminal moving means for detaching the front end part of the wire from said clamping means includes means for simultaneously upwardly lifting said wire chuck and said terminal chuck.

5. A mechanism for inserting a wired terminal according to claim 4, wherein said terminal moving means includes inverting driving means for simultaneously inverting said wire chuck and said terminal chuck by 180 degrees to direct the terminal inwardly with respect to the lay-out board.

6. A mechanism for inserting a wired terminal according to claim 5, wherein said terminal moving means includes means for releasing the terminal from gripping by said terminal chuck after a foremost end of the terminal is inserted into the terminal insertion port by said terminal inserting means.

7. A mechanism for inserting a wired terminal according to claim 2, further comprising, wire straightening means for straightening a the front end part of the wire by combing a portion of the front end part of the wire, the straightening means combing the wire from a gripping position where the wire is gripped by said wire chuck, irrespective of whether the wire has been gripped by said terminal chuck.

8. A mechanism for inserting a wired terminal according to claim 7, wherein said terminal moving means includes positioning means, having a positioning surface, for positioning a lower surface of the terminal before gripping by said terminal chuck and after straightening of the wire by said wire straightening means.

9. A mechanism for inserting a wired terminal according to claim 8, wherein said positioning means further includes terminal straightening means for straightening, in a vertical direction, the terminal by clamping the terminal against the positioning surface prior to gripping by said terminal chuck.

10. A mechanism for inserting a wired terminal according to claim 9, wherein said straightening means straightens the terminal, in a lateral direction, by clamping the terminal.

11. A mechanism for inserting a wired terminal according to claim 1, wherein the lay-put board includes stopping means for stopping the intermediate part of the wire.

12. A mechanism for inserting a wired terminal according to claim 11, wherein the stopping means is formed of multiple pin members planted at specified positions on the lay-out board.

13. A mechanism for inserting a wired terminal according to claim 1, wherein the lay-out board is supported on a moving stand, the moving stand being sequentially movable through a laying-out section for laying out wires, a bundling section for bundling laid-out wires, a stripping section for stripping ends of the laid-out wires, a terminal crimping section for crimping terminals to the laid-out stripped ends of the wires, and a terminal insertion section for inserting the terminals into a connector housing.

14. A mechanism for inserting a wired terminal according to claim 13, wherein said housing holding means is supported by the moving stand.

15. A mechanism for inserting a wired terminal according to claim 13, wherein said clamping means is formed of multiple clamp members mounted on the moving stand along one side of the lay-out board.

16. A mechanism for inserting a wired terminal according to claim 15, wherein each of said clamp members includes a pair of clamps for releasably clamping the wire with respective ends of said clamps confronting each other, and biasing means for biasing said clamps for holding the wire.

17. A mechanism for inserting a wired terminal according to claim 15, wherein said housing holding means includes a movable holding member held on the moving stand and capable of moving back and forth along an axis orthogonal to a direction in which the clamp members are arrayed.

18. A mechanism for inserting a wired terminal according to claim 17, wherein said movable holding member serves as a part of said terminal inserting means.

19. A mechanism for inserting a wired terminal according to claim 1, wherein said terminal inserting means includes a sliding means capable of moving said terminal moving means towards the terminal insertion port of the connector housing and the terminal.

* * * * *